US006409607B1

(12) United States Patent
Libit et al.

(10) Patent No.: US 6,409,607 B1
(45) Date of Patent: Jun. 25, 2002

(54) GOLF COURSES AND METHODS OF PLAYING GOLF

(76) Inventors: Jeffrey M. Libit, 13244 Circulo Largo Ct., NE., Albuquerque, NM (US) 87112; Sidney Libit, 2525 Gulf of Mexico Dr., Suite 12D, Longboat Key, FL (US) 34228

( * ) Notice: Subject to any disclaimer, the term of this patent is extended or adjusted under 35 U.S.C. 154(b) by 0 days.

(21) Appl. No.: 09/295,253

(22) Filed: Apr. 20, 1999

(51) Int. Cl.[7] ..... A63B 69/36

(52) U.S. Cl. ..... 473/170; 473/409; 473/192; 473/154

(58) Field of Search ..... 473/168–170, 473/197, 196, 409

(56) References Cited

U.S. PATENT DOCUMENTS

| | | | | |
|---|---|---|---|---|
| 1,489,250 | A | | 4/1924 | Hopwood |
| 1,540,350 | A | * | 6/1925 | Longenecker ..... 473/197 |
| 1,584,093 | A | | 5/1926 | Harris |
| 1,851,423 | A | | 3/1932 | Ely |
| 1,893,278 | A | | 1/1933 | Eriksen |
| 1,894,722 | A | | 1/1933 | Adams |
| 1,979,584 | A | | 11/1934 | Thompson |
| 2,003,074 | A | | 5/1935 | Gage |
| 2,061,973 | A | | 11/1936 | Loeb |
| 2,232,569 | A | | 2/1941 | Johnson |
| 2,455,806 | A | | 12/1948 | Reach |
| 2,482,210 | A | | 9/1949 | Reach et al. |
| 2,490,961 | A | | 12/1949 | Hendry |
| 2,577,690 | A | | 12/1951 | Reach |
| 3,083,021 | A | | 3/1963 | Reilly |
| 3,129,943 | A | | 4/1964 | McKee |
| 3,310,310 | A | | 3/1967 | McKee |
| 3,350,099 | A | | 10/1967 | Smart |
| 3,355,175 | A | | 11/1967 | Carroll et al. |
| 3,399,899 | A | | 9/1968 | Shepherd |
| 3,414,266 | A | | 12/1968 | Mitchell |
| 3,464,703 | A | | 9/1969 | Vallas |
| 3,467,388 | A | * | 9/1969 | Weiler ..... 473/197 |
| 3,599,980 | A | | 8/1971 | Harmond |
| 3,620,536 | A | | 11/1971 | Lau |
| 3,638,944 | A | | 2/1972 | McQueen |
| 3,649,027 | A | | 3/1972 | Vallas |
| 3,685,832 | A | | 8/1972 | Johnson |
| 3,695,619 | A | | 10/1972 | Brobston |
| 3,844,558 | A | | 10/1974 | Gigliotti |
| 3,860,236 | A | | 1/1975 | Buchanan |
| 3,861,680 | A | | 1/1975 | Mowrer |
| 3,892,405 | A | | 7/1975 | Trevino |
| 3,904,209 | A | | 9/1975 | Thomas |
| 3,910,583 | A | | 10/1975 | Appel et al. |

(List continued on next page.)

FOREIGN PATENT DOCUMENTS

| | | |
|---|---|---|
| EP | 0 308 833 | 3/1989 |
| GB | 325441 | 2/1930 |

OTHER PUBLICATIONS

Article entitled "All–Indoor Clubs Are Putting Golfers On Unreal Courses", The Wall Street Journal, Apr. 4, 1991, 2 pages.

*Primary Examiner*—Mark S. Graham
(74) *Attorney, Agent, or Firm*—Bell, Boyd & Lloyd LLC

(57) ABSTRACT

The present invention provides new golf courses and new methods of playing golf. The golf course has a golf ball hitting area used for a plurality of golf holes. A plurality of target greens are spaced at various distances from the golf ball hitting area. A target chipping area is provided adjacent the golf ball hitting area. A putting green is also adjacent the golf ball hitting area. A variety of simulated hazards, such as water hazards and sand traps, may be provided on the golf course. The golf course may be portable. The golf course is played by selecting a target green and shooting for the selected target green. The distance the golf ball traveled is subtracted from the distance to the target green and the remaining distance is used to select the next target green to complete the golf hole.

43 Claims, 9 Drawing Sheets

U.S. PATENT DOCUMENTS

| | | | | | |
|---|---|---|---|---|---|
| 3,942,801 | A | * | 3/1976 | Mintz | 473/169 |
| 3,990,708 | A | * | 11/1976 | Ingwersen | 473/169 |
| 4,063,738 | A | | 12/1977 | Michalson | |
| 4,108,442 | A | | 8/1978 | Bynam | |
| 4,148,490 | A | | 4/1979 | Goransson | |
| 4,171,134 | A | * | 10/1979 | Reck | 473/196 |
| 4,283,056 | A | | 8/1981 | Miller | |
| 4,303,245 | A | | 12/1981 | Brockett | |
| 4,327,917 | A | | 5/1982 | Bagley | |
| 4,504,055 | A | | 3/1985 | Wells | |
| 4,531,742 | A | | 7/1985 | Craycraft | |
| 4,564,198 | A | | 1/1986 | Kwik | |
| 4,572,512 | A | | 2/1986 | Tegart | |
| 4,630,828 | A | | 12/1986 | Lovin | |
| 4,696,474 | A | | 9/1987 | Tegart | |
| 4,743,026 | A | | 5/1988 | Eady | |
| 4,798,385 | A | | 1/1989 | Tegart | |
| 4,815,020 | A | | 3/1989 | Cormier | |
| 4,889,342 | A | | 12/1989 | Hugunin | |
| 4,928,973 | A | | 5/1990 | Perry et al. | |
| 4,941,664 | A | | 7/1990 | Pate | |
| 5,265,875 | A | * | 11/1993 | Fitzgerald | 473/169 |
| 5,332,224 | A | | 7/1994 | Libit et al. | |
| 5,401,027 | A | * | 3/1995 | Surbeck | 473/196 |
| 5,439,224 | A | * | 8/1995 | Bertoncino | 473/170 |
| 5,580,320 | A | | 12/1996 | Meikle | 473/197 |
| 6,053,819 | A | * | 4/2000 | Wilk | 473/169 |

* cited by examiner

FIG.12

NAME DATE

REALIVE GOLF® SCORE CARD

| HOLE | 1 | 2 | 3 | 4 | 5 | 6 | 7 | 8 | 9 | | 10 | 11 | 12 | 13 | 14 | 15 | 16 | 17 | 18 |
|---|---|---|---|---|---|---|---|---|---|---|---|---|---|---|---|---|---|---|---|
| YARDS TO HOLE GREEN (YTG) | 102 | | | | | | | | | | | | | | | | | | |
| SHOT YARDS 1 [subtract] | 104 | | | | | | | | | | | | | | | | | | |
| REMAINING YARDS TO GREEN (RYG) | 106 | | | | | | | | | | | | | | | | | | |
| YARDS TO NEAREST TARGET GREEN (SEE CHART) | 108 | | | | | | | | | | | | | | | | | | |
| SHOT YARDS 2 [subtract] | 110 | | | | | | | | | | | | | | | | | | |
| REMAINING YARDS TO GREEN (RYG) | 112 | | | | | | | | | | | | | | | | | | |
| YARDS TO NEAREST TARGET GREEN (SEE CHART) | 114 | | | | | | | | | | | | | | | | | | |
| SHOT YARDS 3 [subtract] | 116 | | | | | | | | | | | | | | | | | | |
| REMAINING YARDS TO GREEN (RYG) | 118 | | | | | | | | | | | | | | | | | | |
| YARDS TO NEAREST TARGET GREEN (SEE CHART) | 120 | | | | | | | | | | | | | | | | | | |
| SHOT YARDS 4 [subtract] | 122 | | | | | | | | | | | | | | | | | | |
| REMAINING YARDS TO GREEN (RYG) | 124 | | | | | | | | | | | | | | | | | | |
| YARDS TO NEAREST TARGET GREEN (SEE CHART) | 126 | | | | | | | | | | | | | | | | | | |
| SHOT YARDS 5 | 128 | | | | | | | | | | | | | | | | | | |
| PUTTING DISTANCE (40', 20', 10',___'SEE CHART) | 130 | | | | | | | | | | | | | | | | | | |
| SHOTS TO GREEN (1, 2, 3, 4, 5,___) | 132 | | | | | | | | | | | | | | | | | | |
| PUTTS | 134 | | | | | | | | | | | | | | | | | | |
| PENALTIES | 136 | | | | | | | | | | | | | | | | | | |
| HOLE SCORE 9 HOLE 18 HOLE | 138 | | | | | | | | | | | | | | | | | | |

100

FIG.13

REALIVE GOLF® TARGET GREEN SELECTION CHART

| IF THE REMAINING YARDAGE TO THE GREEN IS MORE THAN: | SHOOT AT |
|---|---|
| 325 YARDS | 350 YARD GREEN |
| 275 YARDS | 300 YARD " |
| 225 YARDS → | 250 YARD " |
| 175 YARDS | 200 YARD " |
| 125 YARDS | 150 YARD " |
| 75 YARDS → | 100 YARD " |
| 25 YARDS | 50 YARD " |

LESS THAN 25 YARDS → CLOSEST GREEN (10 YARDS)

FIG.14

REALIVE GOLF® THREE PUTT DISTANCE CHART

| | |
|---|---|
| HIT THE GREEN CENTER GAZEBO | 10 FEET |
| LAND BETWEEN GAZEBO & PERIMETER | 20 FEET |
| LAND ON GREEN PERIMETER (OR TAKE MORE THAN PAR NUMBER OF STROKES TO LAND ON GREEN) | 40 FEET |

FIG.15

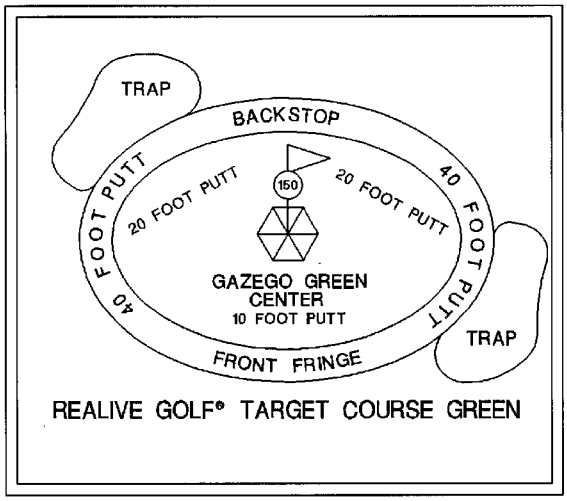

REALIVE GOLF® TARGET COURSE GREEN

GOLF COURSES AND METHODS OF PLAYING GOLF

FIELD OF THE INVENTION

The present invention generally relates to golf courses and methods of playing golf. More specifically, the present invention relates to golf courses in which multiple golf holes are played from a single golf ball hitting area and methods of playing golf on such golf courses.

BACKGROUND OF THE INVENTION

Over the last decade the golf industry has witnessed a growth of unparalleled precedence. As we move into the 21$^{st}$ Century, player access to golf is limited by land use, space, ecological problems, the number of people playing the game, weather conditions, financial costs and the length of time required to play a round of golf, for example. More populated areas have failed to keep pace with the astronomically growing player demand for golf.

Alternatives to playing ordinary golf have not satisfied the desires or demands of golfers to play golf. Golf driving ranges, short courses (par 3 and short ball), video and virtual reality games fail to provide a real and complete golf playing alternative. One of the most enjoyable aspects of playing golf is the ability to shoot a controlled golf club shot and watch one's golf ball fly through the air and land on target. Such desired aspects of ordinary golf have not been met by existing alternatives to playing ordinary golf.

A round of eighteen (18) holes of ordinary golf played on a typical golf course generally requires a substantial amount of time. A relatively fast round of eighteen holes of golf can take approximately four hours to play, and it is not uncommon for a round of golf to take five hours or more. This time requirement to play golf can discourage and prohibit players from playing golf.

Typical golf courses are laid out over a relatively large area of land. Golfers must either walk the course or ride in a golf cart. However, some golfers may not have the physical ability to walk a golf course, and the use of golf carts may not be desired, for example for ecological reasons.

Traditional golf courses are permanently installed at the location chosen for the course. In other words, traditional golf courses are "built into" the landscape and terrain, with changes to the landscape and terrain being made as desired. Accordingly, ordinary golf courses cannot be moved to a new location or easily modified. Also, golf courses may not be built in certain areas because those areas do not provide the desired landscape and terrain for a golf course. Traditional golf courses are quite expensive to plan, construct, modify and maintain.

U.S. Pat. No. 5,332,224 is entitled "Convenient Golf Game with Adjustable Out-of-Bounds Markers," and was issued on Jul. 26, 1994. The '224 patent pertains to a convenient golf game with adjustable out-of-bounds markers which has enclosed tee areas with doors that can be manually or automatically moved to coincide with particular out-of-bounds markers. The doors may be pivoted or slidable. Golf shots can be made to a fairway that has a number of greens.

SUMMARY OF THE INVENTION

The present invention provides new golf courses and methods of playing golf. The golf course allows a round of golf to be played in a short period of time and by golfers of all abilities, even golfers with physical disabilities. The majority of non-playing time is removed from the game because golfers do not travel (walk or ride) throughout the course from one hole to the next. Golfers hit all golf shots from the golf ball hitting area. A nine hole round of golf can be played in less than one-half hour and an eighteen hole round can be played in less than one hour. Golf can be played on the new golf course in various weather conditions. Accordingly, the golf course provides more golfers with the ability to play golf. A typical 18 hole golf course requires 120 to 150 acres of land, whereas golf courses of the present invention may require less than 4 percent of that acreage to accommodate the capacity of a 36 hole golf course.

The golf course is portable because the components are easily removable. The golf course can be set-up and played for specific events and then moved to a new location as desired. The portability, modularity and ease of maintenance of the golf courses provide relatively inexpensive golf courses (and golf courses which can be easily modified) as compared to the cost to design, construct, maintain and modify traditional golf courses.

Golf courses of the present invention can be portable or permanently installed. A portable installation allows for temporary use of the golf course, for example for a specific event or tournament. The golf course can be easily relocated to a new location when desired.

One new golf course according to the present invention includes a golf ball hitting area used for a plurality of golf holes, a plurality of target greens spaced at various distances from the golf ball hitting area, a target chipping area adjacent the golf ball hitting area and a putting green adjacent the golf ball hitting area. Simulated hazards may also be provided and spaced away from the golf ball hitting area. Examples of the simulated hazards include water hazards, sand traps or bunkers, rough and various combinations of those hazards.

The target greens and hazards are constructed of modular sections in which each section has a frame and a fabric panel which is color coded to designate a particular golf course feature. For example, target greens are made from various green colored sections, sand traps are made from various white colored sections, and water hazards are made from various blue colored sections. The sections are modular and can be combined or arranged as desired. Rough fairway areas can be made from brightly contrasting chartreuse or optical yellow color materials which contrast to the green color for the target greens. The frames for the various sections may be fully or partially covered with the fabric. For example, a frame for a green section may be fully covered with green fabric and frames for hazard sections (water, rough and sand trap) may have banners or pennants. Also, the sections are height adjustable for fine tuning of the course and can increase player visibility of the sections. The modular sections may be permanently installed, or removably installed which allows the golf course to be portable.

The golf ball hitting area may include a tee shot hitting area, a fairway shot hitting area, a sand hitting area, a rough hitting area and various combinations of those areas. Protective netting may be provided around the golf ball hitting area. Netting provided in front of the golf ball hitting area can be adjusted to simulate out-of-bounds and can be fully closed for practicing golf shots.

Various distance markers can be placed along the length of the golf course. The target chipping area may have various target cups or locations which include a flag on a pole and also distance markers spaced away from the target cups. The putting green may have various holes to simulate different green layouts and putting distances.

Another golf course according to the present invention may include a plurality of golf ball hitting areas adjacent each other and a set of target greens spaced at various distances from the golf ball hitting areas, in which all of the golf ball hitting areas are associated with the same set of target greens. A target chipping area may be positioned adjacent the golf ball hitting areas. The target chipping area has a plurality of target cup locations and a distance indicator indicative of various distances from the target cup locations. Each target cup location is associated with one of the golf ball hitting areas. A putting green is adjacent the golf ball hitting areas and has a plurality of target cups.

One method of making a golf course according to the present invention includes providing a golf ball hitting area used for a plurality of golf holes, providing a plurality of target greens spaced at various distances from the golf ball hitting area, providing a target chipping area adjacent the golf ball hitting area and providing a putting green adjacent the golf ball hitting area. The method of making the golf course may also include providing at least one simulated hazard spaced away from the golf ball hitting area. The method may also include providing the golf ball hitting area with areas which may include a tee shot hitting area, a fairway shot hitting area, a sand hitting area, a rough hitting area and combinations of those areas.

One method of playing golf according to the present invention includes selecting a target green from a plurality of target greens spaced at various distances from a golf ball hitting area, hitting a golf ball from the golf ball hitting area toward the selected target green, determining a remaining distance between the golf ball and the selected target green, selecting a target green which has a distance from the golf ball hitting area corresponding to the remaining distance (i.e., a distance equal, closest or nearest to the remaining distance) and hitting the golf ball from the golf ball hitting area toward the next target green. The steps are repeated until the golf ball is on the selected target green. The method of playing golf may include rounding the remaining distance to be about equal to the distance the next target green is from the golf ball hitting area. The method may also include hitting the golf ball towards the target chipping area adjacent the golf ball hitting area when the remaining distance is less than a distance from the golf ball hitting area to a target green closest to the golf ball hitting area by a predetermined amount. The method of playing golf may further include placing the golf ball on a putting green adjacent the golf ball hitting area when the golf ball lands on the last selected target green and putting the golf ball. The golf ball may be placed on the putting green at a distance from a cup which is equal to the same actual distance that the ball lies from the target pin in the target green. Alternatively, the golf ball may be placed on the putting green at a predetermined distance from a cup depending on the ball's resting position on the target green, for example 10 ft., 20 ft. or 40 ft. predetermined putting distances.

The golf course of present invention is easily installed on existing driving range facilities on public and private courses which provides for more golf use without an excessive economic burden on course or land or economic resources. It is easy to retrofit the driving range or a portion of an existing driving range with the new golf course. Furthermore, methods of playing golf of the present invention allow for golf course teaching lessons and the conduct of professional tournaments in a shorten time frame without burdening course resources or player access.

Objects and advantages of the present invention will become apparent upon reading this disclosure including the appended claims and with reference to the accompanying drawings. The objects and advantages may be desired, but are not necessarily required to practice the present invention.

BRIEF DESCRIPTION OF THE DRAWINGS

FIG. 12 shows a score card for use with golf courses of the present invention.

FIG. 13 shows a green selection chart for use with golf courses of the present invention.

FIG. 14 shows a three putt distance chart for use with golf courses of the present invention.

FIG. 15 shows a three putt distance diagram for use with golf courses of the present invention.

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

Figure 1:
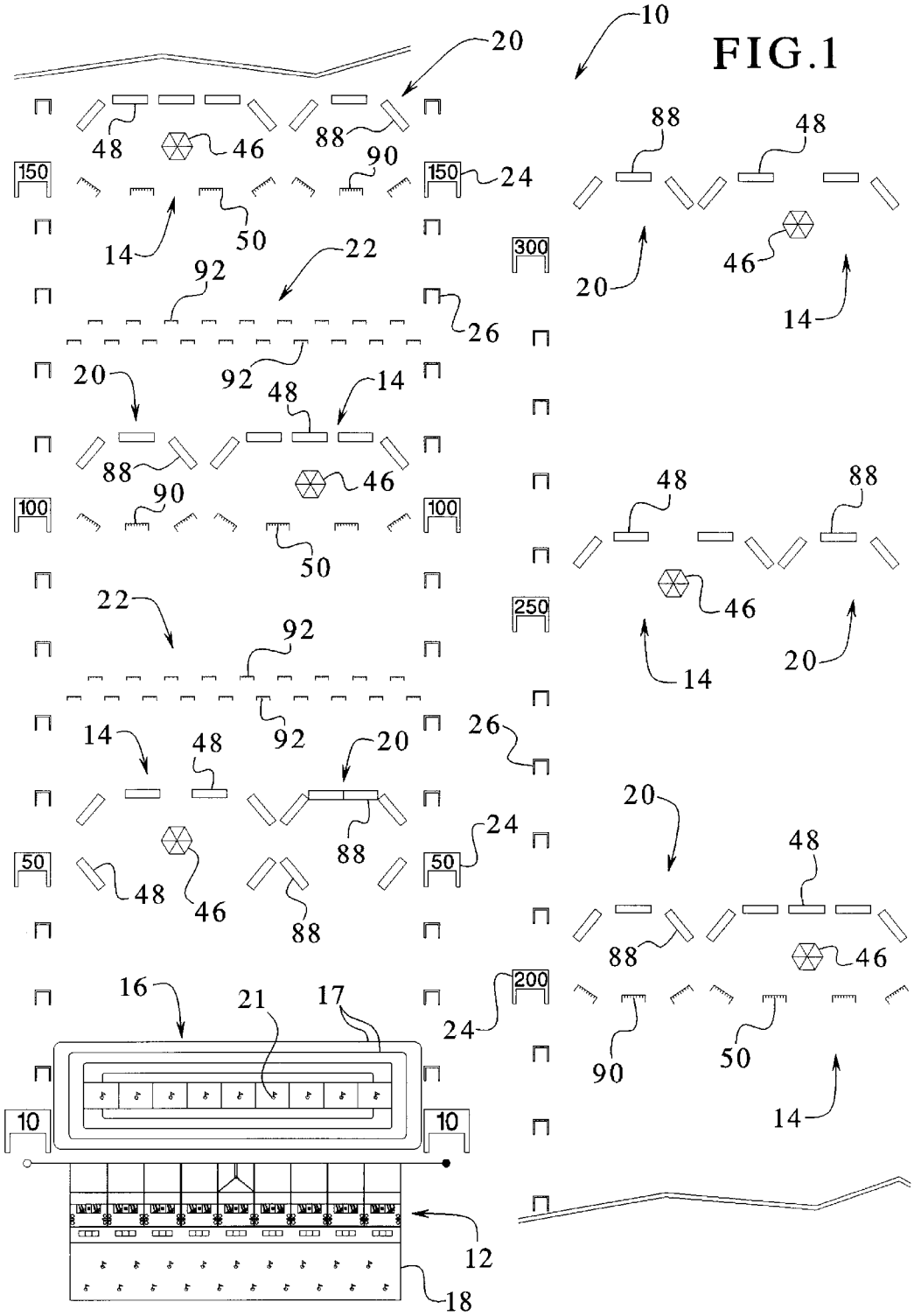
FIG. 1 is a top plan view of a golf course according to the principles of the present invention.

A new golf course 10 according to the principles of the present invention is shown by way of example in FIG. 1. FIG. 1 shows the golf course 10 broken between a 150 yard target green 14 and a 200 yard target green 14. The actual golf course 10 would be continuous from the golf ball hitting area 12 to a furthest target green 14, for example the 300 yard target green 14. The golf course 10 has at least one golf ball hitting area 12 (multiple golf ball hitting areas 12 are shown adjacent each other in FIG. 1) and a plurality of target greens 14 spaced at various distances outward from the hitting area 12. A target chipping area 16 and a putting green 18 are provided adjacent the golf ball hitting area 12. As shown in FIG. 1, the target chipping area 16 can be positioned between the golf ball hitting area 12 and the target greens 14, and the putting green 18 can be positioned behind the golf ball hitting area 12. The target chipping area 16 has distance markings 19 which indicate how close a golf ball which was a chip shot is to a selected hole location 21. Each hole location 21 includes a flag on a pole. The hole location 21 may be an actual hole in the ground into which a golf ball can fall, or the hole location 21 may merely be a location where the flag pole meets the target chipping area 16. The target chipping area 16 and the putting green 16 may be made from astro turf, synthetic carpet materials or short grass in trays with painted distance markings 17, for example.

Various types of hazards, for example sand traps 20 and water hazards 22, may be positioned at desired locations outward from the hitting area 12. Other hazards, such as rough and out-of-bounds, can be provided as desired. Areas between the target greens 14 or outside of the hazards can be designated as fairway or rough, for example. Distance markers 24 are positioned at various distances outward from the golf ball hitting area 12 and indicate distances from the hitting area 12. Additional markers 26 can be provided which indicate distances between the distance markers 24 and out-of-bounds areas to the left or right side of the golf course 10. The markers 24, 26 can be installed similar to the sections of the target greens 14 and hazards 20, 22 discussed below and are also height adjustable similar to those sections. One reason for height adjustability of the sections is to increase player visibility of the sections, for example, a particular section may be adjusted to a higher position which increases its visibility.

The golf course 10 is modular due to the structure of the target greens 14, hazards, 20, 22, front and rear sections of the target greens and hazards (described below), and distances markers 24, 26. The target chipping area 16, golf ball hitting area 12 and putting green 18 also contribute to the modularity of the golf course 10. All of the components of the golf course 10 can be positioned as desired which provides great flexibility in the golf course 10.

The golf course 10 allows multiple, different holes of golf (such as an entire nine or eighteen hole round of golf) to be played. Nearly all golf shots, except putting, are hit from the golf ball hitting area 12 toward a selected target green 14 or the target chipping area 16. Putting, of course, occurs on the putting green 18. The various target greens 14 and hazards create different golf holes having different tee-to-green distances and hazards all played from a single golf ball hitting area 12, as will be further described below.

A plurality of golf ball hitting areas 12 are shown adjacent to one another in FIG. 1. Multiple golf ball hitting areas 12 allow multiple golfers to play on the same golf course 10 simultaneously. For example, different foursomes may simultaneously play the golf course 10 from different golf ball hitting areas 12. Golfers in different golf ball hitting areas 12 may be hitting toward the same or different target greens 14 at the same time without interfering with each other. Accordingly, the separate foursomes can play different golf holes, even different combinations of golf holes, while simultaneously playing on the same golf course 10. The separate foursomes can play different "golf courses" from the different golf ball hitting areas 12 while playing on the same golf course 10 because the foursomes are hitting toward selected target greens 14 independent of the other golfers and the golfers do not walk down the golf course 10.

The example of the golf course 10 shown in FIG. 1 shows nine (9) golf ball hitting areas 12, and the first 10 yard target chipping area 16 through the 300 yard target green 14. The width of the fairway may range from approximately 180 feet to 300 feet or more depending upon space availability. Each golf ball hitting area 12 is approximately 12 feet wide, but can be increased or decreased as desired. These dimensions are merely examples, and the golf course 10 can be designed as desired. The relatively compact nature of the golf course 10 represents a considerable savings of land use for a golf course.

Figure 2:
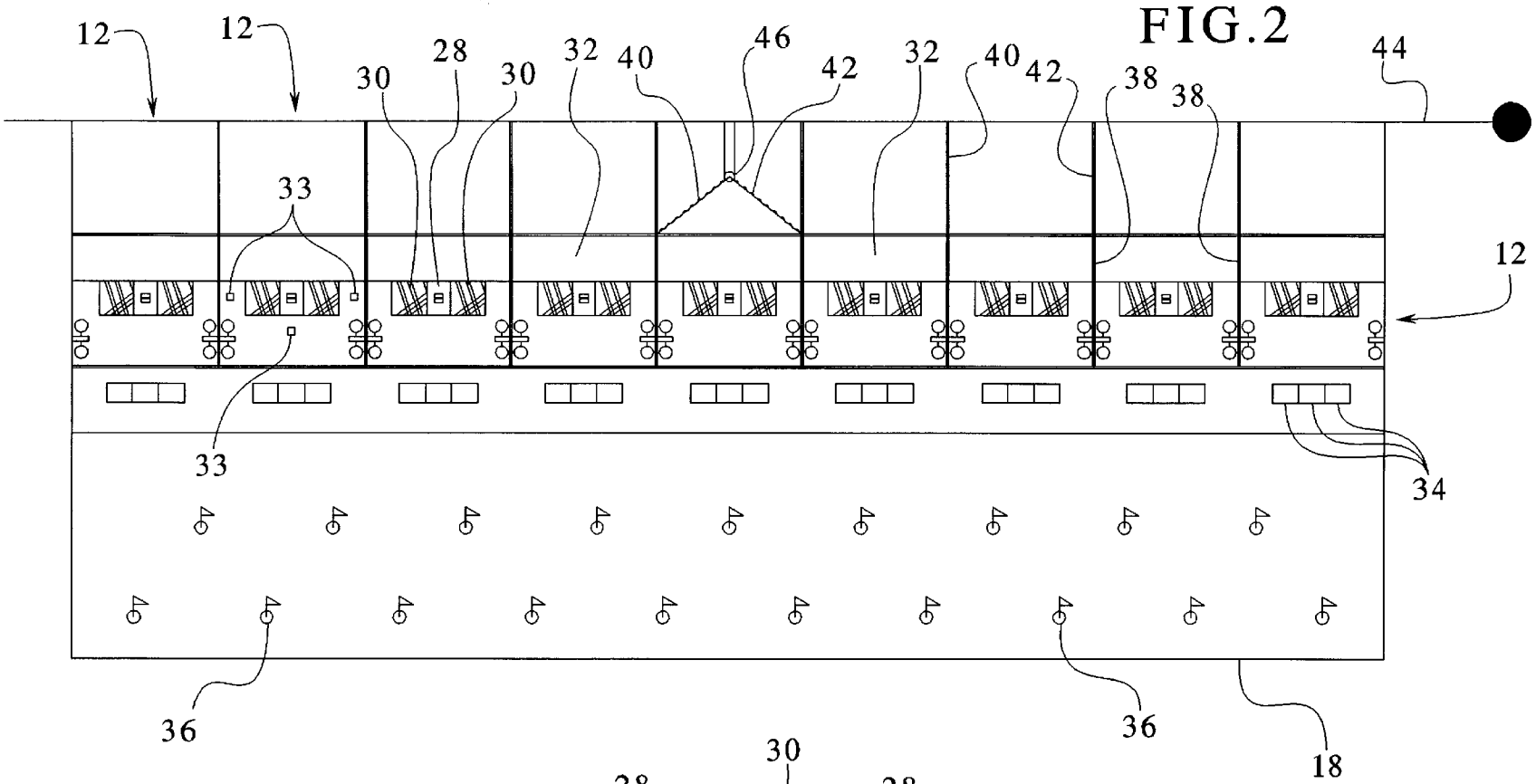
FIG. 2 is a top plan view of a golf ball hitting area and a putting green of the golf course of FIG. 1.
Figure 2A:
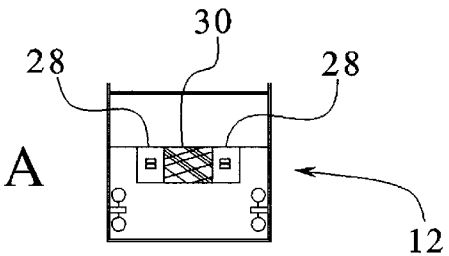
FIG. 2A is a top plan view of a portion of an alternative golf ball hitting area.

The golf ball hitting areas 12 and the putting green 18 are shown in greater detail in FIG. 2. Each golf ball hitting area 12 has a standing area 28 where the golfer stands when hitting a golf shot from a hitting surface 30. Multiple standing areas 28 and hitting surfaces 30 may be provided as desired. For example, two hitting surfaces 30 can be positioned on opposite sides of the standing area 28 to accommodate left-handed and right-handed golfers. One alternative layout is shown in FIG. 2A where left and right standing areas 28 are positioned on either side of a hitting surface 30. Furthermore, the standing area 28 and hitting surfaces 30 can provide different types of ground terrain that a golfer may hit from, such as a tee area, fairway, rough, flat or sloped areas, for example. Natural grasses or synthetic surfaces can be used for the standing area 28 and the hitting surfaces 30.

A sand hitting area 32 is provided for hitting out of sand traps or bunkers. The sand hitting area 32, standing area 28 and hitting surfaces 30 for each tee shot area for each group of players can be portable or permanently installed. The standing area 28 and hitting surfaces 30 can be made from removable trays which contain actual sod or turf. The trays can be used to easily install and remove the areas and surfaces. When sod or turf in a tray becomes worn or it is otherwise desired to replace the sod or turf, the trays can be removed and replaced with other trays. In this manner, the trays can be rotated to keep the sod or turf in playable condition.

Tray rotation provides actual turf to hit off of in a golf game or within a driving range and allows the use of recyclable sod in square trays, as with the other hitting surfaces, to be rotated into the golf ball hitting area 12. A movable tee line which is commonly used on driving ranges to alter the hitting location is not required because of the rotatable trays. The golf ball hitting area 12 may be stationary which allows for the use of covered tees within a driving range or golf game concept without having to have an expensive and movable tee cover which has to move with a movable tee line. Accordingly, the system of using sod and trays and rotating the trays having the sod back to a growing area and recutting it for future renewable use over and over again (a complete renewable resource) not only provides for the reuse of the resource but also provides for a fixed tee line area which requires less land space and maintenance to operate. Accordingly, the golf course can have a covered stationary structure to cover the outdoor tees while providing a real turf grass surface for golfers to play on.

Referring to FIGS. 1 and 2, golf shots (for example, hitting tee, fairway, chip, rough and sand shots) are hit from the hitting surfaces 30 and the sand hitting area 32 toward a selected target green 14 or the target chipping area 16.

Referring to FIG. 2, waiting areas 34 may be provided for golfers to sit and wait until their turn to hit a golf shot. The waiting areas can be arranged at any safe location as desired.

The putting green 18 has multiple holes 36 for putting, which allows for various putting conditions, such as sloped, flat, fast greens, slow greens and breaking areas.

Each golf ball hitting area 12 has side and overhead top see-through netting which protects golfers and spectators from miss-hit or errant golf balls. Side netting 38 separates adjacent golf ball hitting areas 12. Also, an overhead cover can be placed over the golf ball hitting area 12 to provide shade and rain protection for the golfers. Side and rear walls around the entire multiple tee shot area may be added to provide golfers with protection for various weather conditions.

Left and right front netting panels 40, 42 extend outward from the front of the golf ball hitting area 12. The left and right front netting panels 40, 42 are suspended from an overhead cable 44 and have ends which are movable toward and away from each other on the overhead cable. The left and right front netting panels 40, 42 can be independently placed at various open positions which define left and right out-of-bounds for a particular golf hole. If a golf ball hits one of the left and right front netting panels 40, 42, then the golf shot is deemed out-of-bounds. The left and right front netting panels 40, 42 also protect the surrounding area from flying golf balls. Each golfer can adjust the desired position of the left and right front netting panels 40, 42 as desired, for example to increase or decrease the difficulty of play and to control slices and hooks. The left and right front netting panels 40, 42 can be placed in a closed position 46 which prevents all golf balls from leaving the golf ball hitting area 12. Closing the front netting panels 40, 42 allows the golfer to practice hitting the golf ball without losing any golf balls. One alternative suspension mechanism for the front netting panels is to suspend the netting panels similar to shower curtains on a rod or cable. Each tee area 12 may have its own "shower curtains" and suspension rod or cable. Climate control can be provided for the golf ball hitting area. For example, heaters can keep the golf ball hitting area 12 warm and fans, misters or air conditioners can keep the area cool.

Referring to FIG. 1, each target green 14 has a green center 46 and multiple green sections, which may include a rear green section 48 and a front green section 50. Together, these define the boundary of the target green 14. The green center 46 identifies the "hole" in the green and can be placed at any desired position within the target green 14. Accordingly, placement of the green center 46 determines whether the hole is positioned to the center, front, rear or side of the target green 14.

Figure 4:
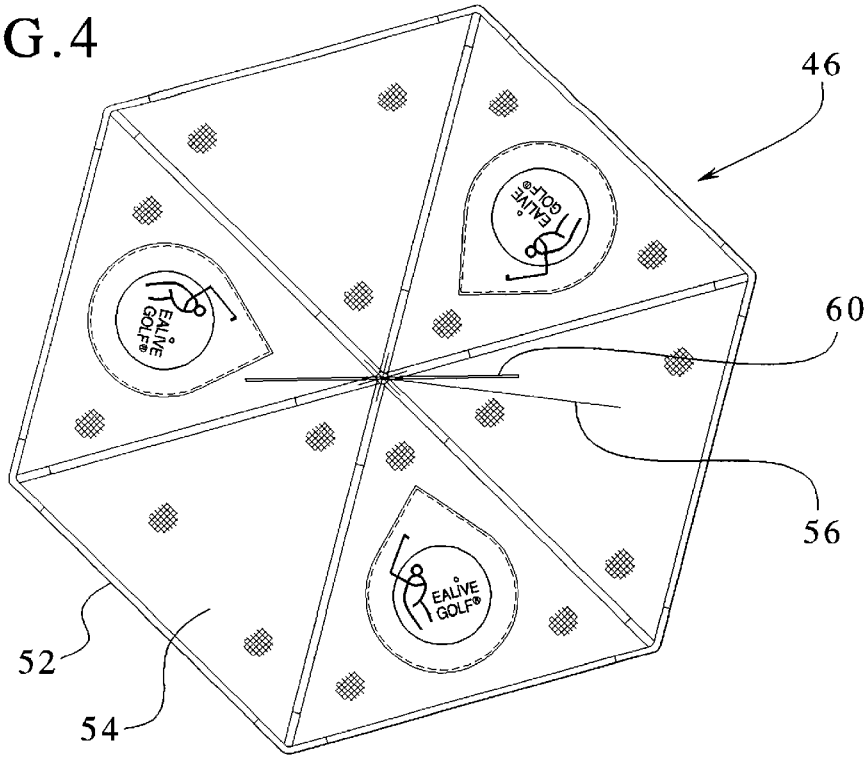
FIG. 4 is a top plan view of the green center of FIG. 3.
Figure 3:
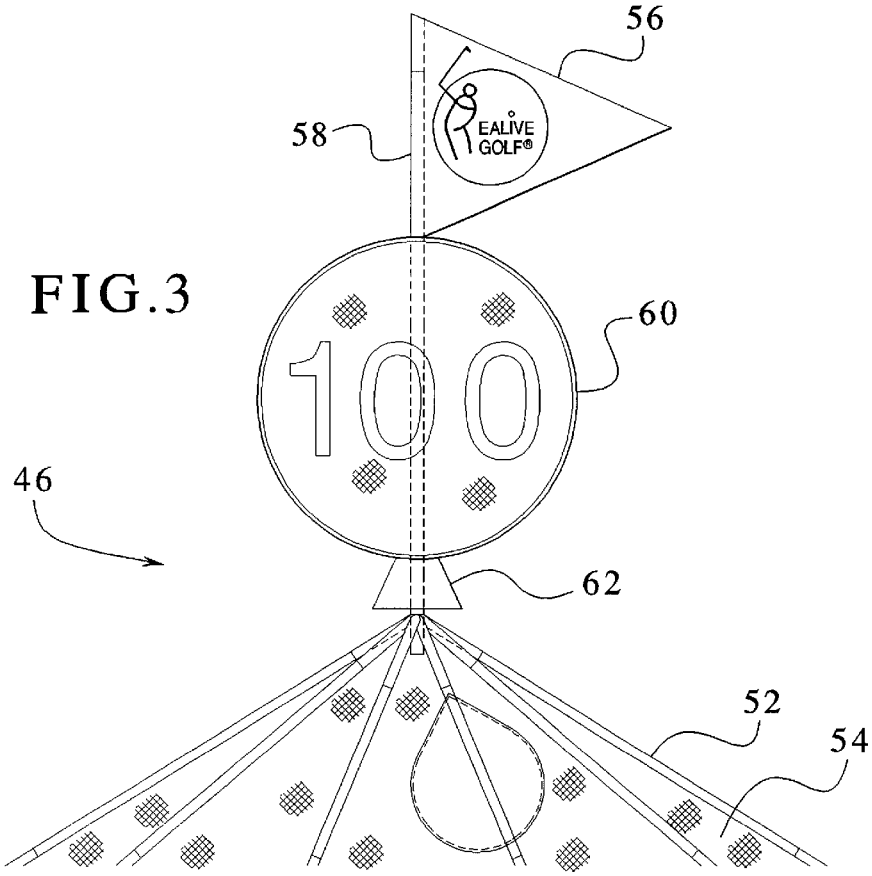
FIG. 3 is a front elevational view of a green center for a target green of the golf course of FIG. 1.

The green center 46 is shown in greater detail in FIGS. 3 and 4. A base frame 52, constructed of PVC or galvanized pipe having a green color for example, is covered with a green colored fabric 54. The fabric 54 allows water and sunlight to pass through which permits plant growth underneath the green center 46. Wind also passes through the fabric 54 so the green center 46 is not easily blown over when not anchored to the ground. A flag 56 on a flag pole 58 identifies the hole in the green. A distance marker 60 can be provided to inform the golfer of the distance from the golf hitting area (FIG. 1) to the hole in the target green 14.

A simulated hole 62 in the green provides the golfer with an indication when the hole 62 is hit by a golf ball. For example, the simulated hole 62 can be a sonic alarm (such as a bell) and/or provide a visual indication that the golf ball has landed in the "hole" 62. The fabric 54 is slanted upward on the base frame 52 which tends to deflect a golf ball generally upward into the air so that a golfer can see that the golf ball has landed on the green center 46. Another indicator (audio or visual, for example) can be provided to indicate when the golf ball hits the green center 46 without hitting the "hole" 62. The green center 46 is shown as having a gazebo shape; however, other shapes can be used.

The green center 46 can be movably or permanently installed on the ground. A movable installation may include merely placing the green center 46 at a desired position within the target green 14 or temporarily anchoring the green center 46 to the ground, for example. Permanent installation may include cementing the base frame 52 into the ground, for example. Movable installation of the green center 46 allows the location of the "hole" in the target green 14 to be changed for varying the golf course 10 and also allows for maintenance of the ground underneath the green center 46, such as cutting the grass, fertilization and aeration.

Figure 6:
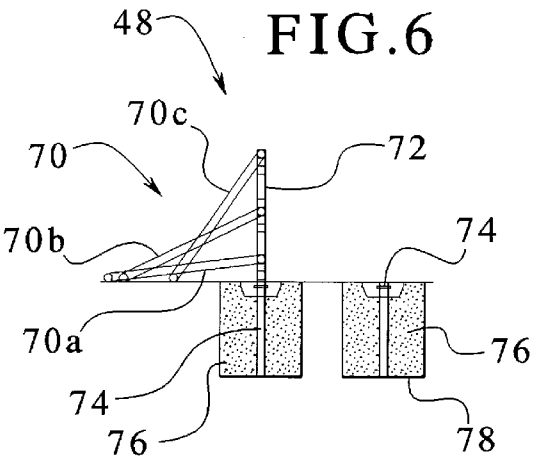
FIG. 6 is a side elevational view of the rear green section of FIG. 5.
Figure 5:
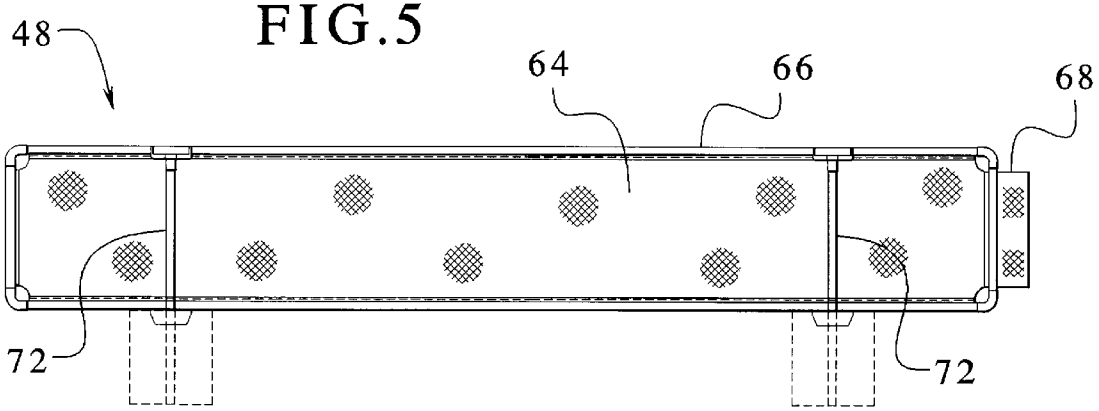
FIG. 5 is a front elevational view of a rear green section for a target green of the golf course of FIG. 1.

The rear green section 48 is shown in FIG. 5. The rear green section 48 has a green colored fabric 64 carried by a section frame 66, made from PVC or galvanized pipe having a green color, for example. Panel flaps 68 of the fabric 64 may extend beyond the section frame 66 to enlarge the rear green section 48 if desired. The fabric 64 used on the rear green section 48 can be the same type of fabric used for the green center 46. Referring to FIGS. 5 and 6, the fabric 64 is attached to a front frame section 70 which is adjustably mounted to vertical supports 72. As can be seen in FIG. 6, the front frame section 70 can be adjusted to various angled positions 70*a*, 70*b*, 70*c* as desired. This allows for adjustment and fine tuning of the golf course. Also, the angled fabric 64 tends to deflect a golf ball up into the air so a golfer can see that the golf ball landed on the green section.

The rear green section 48 can be installed similar to the installation of the green center 46 discussed above. One installation of the rear green section 48 is shown in FIGS. 5 and 6 and includes a ground sleeve 74 anchored to the ground by concrete 76. The vertical supports 72 of the rear green section 48 are slid into the ground sleeves 74 to hold the rear green section 48 upright. Multiple sets of ground sleeves 74, such as set 78, can be provided to allow various placements of any particular rear green section 48. This allows for changes to the golf course layout and maintenance of the ground underneath the green section 48.

Figure 8:
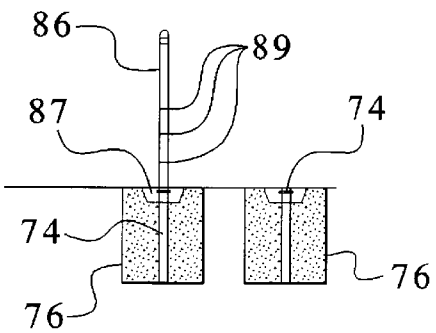
FIG. 8 is a side elevational view of the front green section of FIG. 7.
Figure 7:
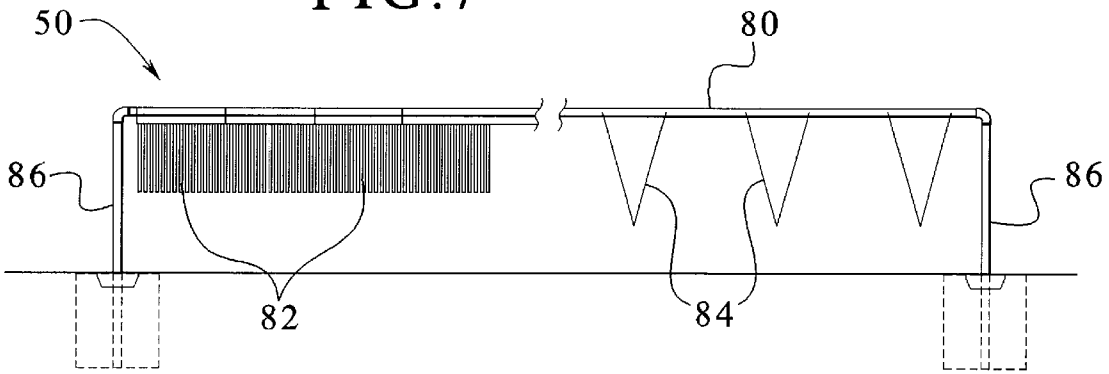
FIG. 7 is a front elevational view of a front green section for a target green of the golf course of FIG. 1.

FIGS. 7 and 8 show a front green section 50 of a target green 14. The front green section 50 has a frame section 80 which can be mounted in a selected set of ground sleeves 74. Green colored fabric panels 82 or green colored fabric flags 84 are attached to the frame section 80. The panels 82 and flags 84 or other shapes can be used as desired. By using a particular shape or size of panel, flag, etc., the target green 14 can be made more or less visible to a golfer at the golf ball hitting area 12. This may assist the golfer in identifying the front of the target green 14 from the back of the target green 14. Golf balls can easily travel through a front green section 50 because the panels 82 or flags 84 do not completely cover the frame section 80.

Vertical supports 86 of the frame section 80 can be adjustable to various height positions. This allows adjustment and fine tuning of the front green sections 50. A pin 87 can be placed in a selected hole 89 in the support 86 which defines a limit in which the support 86 can drop down into the ground sleeve 74. The height of the section 50 can be adjusted depending on which hole 89 the pin 87 is placed in. The vertical supports 72 of the rear green section 48 and the markers 24, 26 can be similarly adjusted with a pin and holes. If desired, a rear green section 48 could be used at the front of the target green 14 and a front green section 50 could be used at the back of the target green. Additional panels 82 flags 84, pennants or barriers tapes may be strung between green sections 48, 50 to "fill-in" areas between the green sections, making the target green 14 more visible.

Referring to FIGS. 1, 5 and 7, the sand trap 20 may have a rear sand trap section 88 and/or a front sand trap section 90. The rear and front sand trap sections 88, 90 are constructed similar to the rear. and front green sections 48, 50 of the target green 14. However, the rear and front sand trap sections 88, 90 have white colored fabric and frames to indicate sand rather than green. Similarly, the water hazard 22 has multiple sections 92 constructed similar to the rear and/or front green sections 48, 50. However, the water hazard sections 92 have blue colored fabric and frames to indicate water rather than a green or sand. Other golf course terrain can be simulated by construction of similar sections having different colored fabric, for example, chartreuse or yellow optic for rough areas. For more permanent installations, actual hazards, such as a water pond or sand traps can be placed on the golf course 10 in addition to or instead of simulated hazards. This may depend on the availability of natural resources.

Referring to FIG. 1, the specific layout of the golf course 10 shown is not necessarily required. The location, size, number and other parameters of the target greens 14 and hazards 20, 22 can be varied as desired. Also, any particular target green 14 or hazard 20, 22 can be made of any desired number and location of rear and/or front sections. These sections may also be used on the sides of the target green 14 and hazards 20, 22. The layout shown in FIG. 1 of the golf course 10 shows changes to the course components as one looks out further away from the golf ball hitting area 12. As the distance outward from the golf ball hitting area 12 increases, the 100 yard target green 14, 150 yard target green 14 and 200 yard target green 14 and the sand traps 20 are created using fewer sections covered entirely with fabric and with more sections having panels 82 or flags 84. Also, the left or right placement of a target green 14 and a sand trap 20 are alternated. Staggering the location of the target greens 14 from the fairway center position increases the visibility and provides a better hitting angle for the players. This layout increases the visibility of the target greens 14 and the hazards. The target greens 14, hazards 20, 22, distance markers 24 and markers 26 are all height adjustable which allows graduated height adjustment of those components depending on the distance they are from the golf ball hitting area 12. For example, target greens 14 and sand traps 20 closer to the golf ball hitting area 12 can be lowered to increase the visibility of the target greens 14, sand traps 20 and water hazards 22 which are placed further away from the golf ball hitting area 12. Also, those course components which are further away from the golf ball hitting area 12 can be raised in height to increase their visibility. The ground terrain may have depressions or hills which can be compensated for by adjusting the height of the various components of the golf course 10. Adjustment of the height and angle of the golf course components makes the colored fabrics more visible to the golfer in various light and sun conditions and may be adjusted for each geographical area for maximum visibility without a washout of color visibility.

The golf course 10 may include a golf ball location system. The golf ball location system determines the distance, and possibly direction, that a hit golf ball travels. The golf ball location system can assist the golfer in more precisely locating the position of a golf ball on the golf course 10. For example, referring to FIG. 2, the golf ball location system may have a sensor 33 placed behind, in front of or to one side of the golfer in the golf ball hitting area 12. When the golfer hits a golf ball, the sensor senses the speed and trajectory of the golf ball and determines the distance (and possibly direction) of travel of the golf ball, which is then reported to the golfer. Golf balls hit by other golfers won't interfere with system because the system can be contained in each golf ball hitting area 12 separately. Some golf ball location systems are currently available and can be used with the golf course 10.

Figure 9:
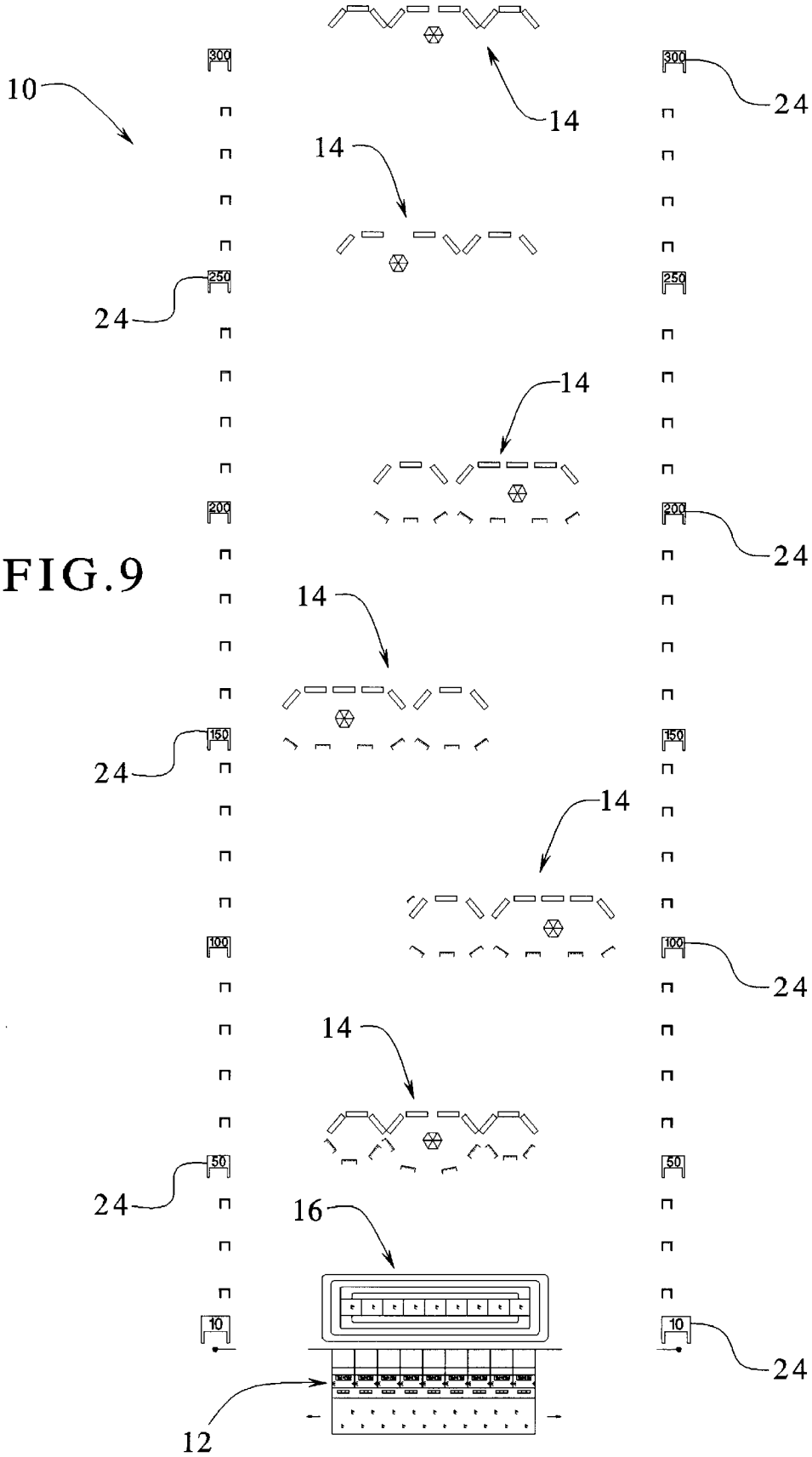
FIG. 9 is a top plan view of another golf course according to the principles of the present invention.

FIG. 9 shows another golf course 10 according to the present invention. The target greens 14 which are farther out from the golf ball hitting area 12 than the target chipping area 16 (which is approximately 10–20 yards from the golf ball hitting area 12) are laid out at 50 yard intervals which may start at the 50 yard marker 24. Of course, the first target green 14 can start at any desire distance from the golf ball hitting area 12. The first target green 14 (50 yards) and the last target green 14 (300 yards) are centered on the fairway with respect to the left and right sides of the fairway. The next two target greens 14 at the 100 and 150 yard markers are placed the greatest distance from the center of the fairway to the right and left sides of the fairway at their respective yardages. The next two target greens 14 at 200 and 250 yards are located inbetween the center of the fairway and the right and left positions of the 100 and 150 yard greens 14. The same principle would apply for a target green layout starting at 25 yards and going out to 325 yards at 50 yard intervals. This diamond shape of the target greens 14 layout is designed to enhance the visibility of the target greens 14 and shooting angles of the players giving player access to all course target greens 14.

Figure 10:
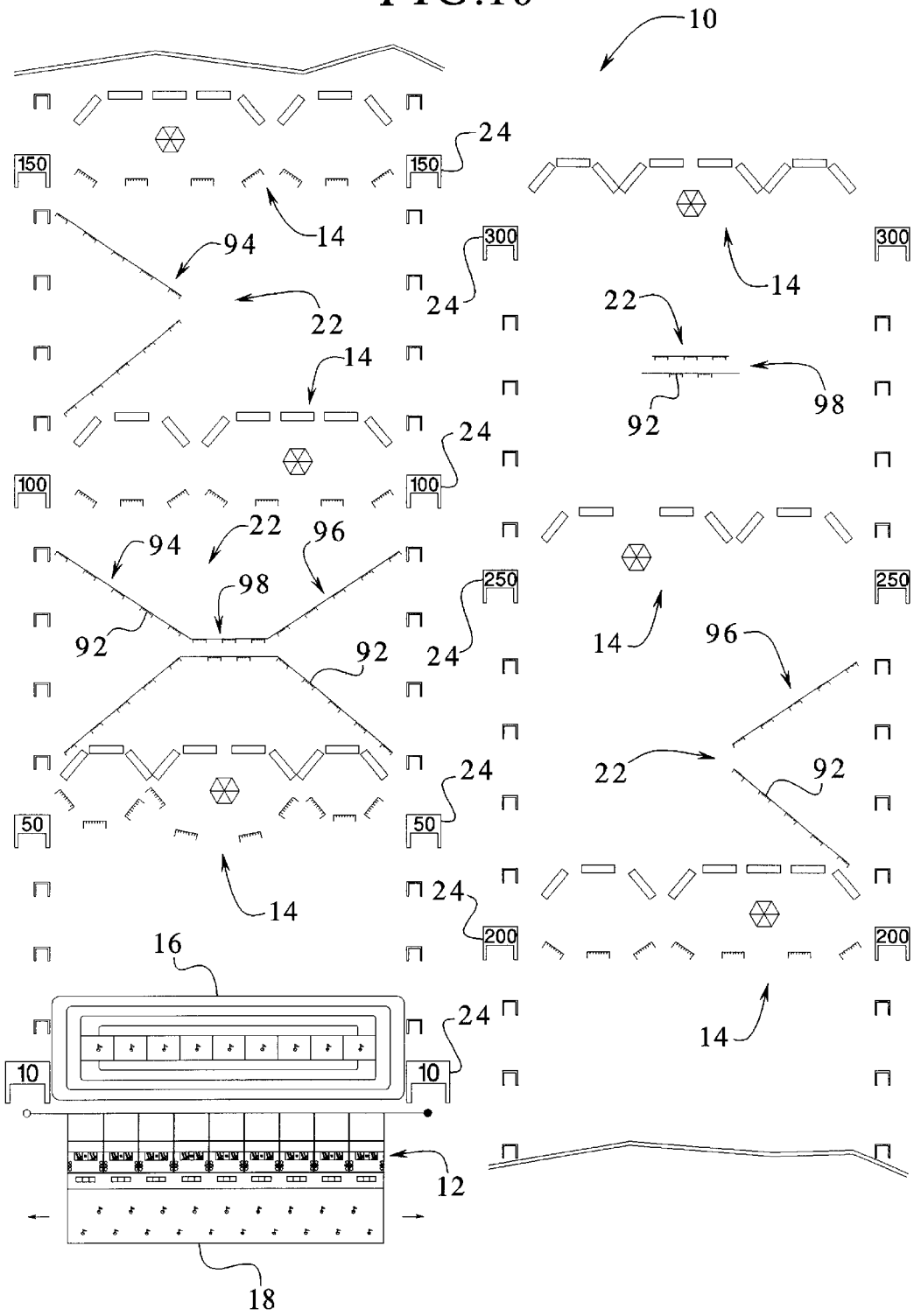
FIG. 10 is a top plan view of another golf course according to the principles of the present invention.

Referring to FIG. 10, another golf course 10 according to the present invention is shown. FIG. 10 shows alternative layouts of the hazards on the golf course 10, while other layouts of the hazards not shown in FIG. 10 could also be used. The water hazard 22 between the 50 and 100 yard markers 24 has three components. A left side 94 of the water hazard 22 represents a side water hazard which is triangular in shape and extends toward the center of the fairway. A right side 96 of the water hazard 22 is a side water hazard having a similar triangular shape which first appears on the right side of the fairway between the 50 and 100 yard target greens 14. An across fairway component 98 of the water hazard 22 is represented by two sets of parallel blue water hazard sections 92, including banners and pennants and represents the connecting portion of the water hazard 22 linking the left side 94 and the right side 96 across the fairway. The water hazard 22 is constructed of pipe and pennant banners as discussed above and is designed to permit grass cutting and other maintenance and accommodate golf ball picking up equipment without being required to be moved. One or more of the components of the water hazard 22 may be used rather than all three components. For example, a water hazard 22 between the 100 and 150 yard markers 24 only includes a left side 94. A right side 96 of a water hazard 22 is shown between the 200 and 250 yard markers 24. An across fairway component 98 of a water hazard 22 is shown by itself between the 250 and 300 yard markers 24. The layout of the water hazard components is merely suggestive and is not exhaustive of the possibilities for use in the golf course 10.

Rough areas may be designated in the same manner as the water hazard areas 22 shown in FIG. 10. The rough areas can be constructed out of a bright green (chartreuse and highly visible) bright material with attendant banner and pennant material. The rough areas may have various positions between the target greens 14 within any golf course layout similar to the water hazards 22. Also, hazards can be mixed such as providing a water hazard as a left side component 94 and a rough area as a right side component 96.

The various configurations of hazards are merely suggestive and not controlling of the golf course design and display the versatility of the golf course components and their modular and portable characteristics. The angle of the left and right triangular areas 94, 96 which extend into the fairway would probably greater than 90° and encroach less into the fairway to allow more easily playable fairway surfaces. Obviously, a golf ball landing in a rough area would require the next shot to be taken from the rough hitting surface of the golf ball hitting area 12. Unless a particular hazard is not in play for a particular hole. In such a case, the hazard would be ignored and a ball landing on the hazard would be treated as if it landed in the fairway.

Figure 11:
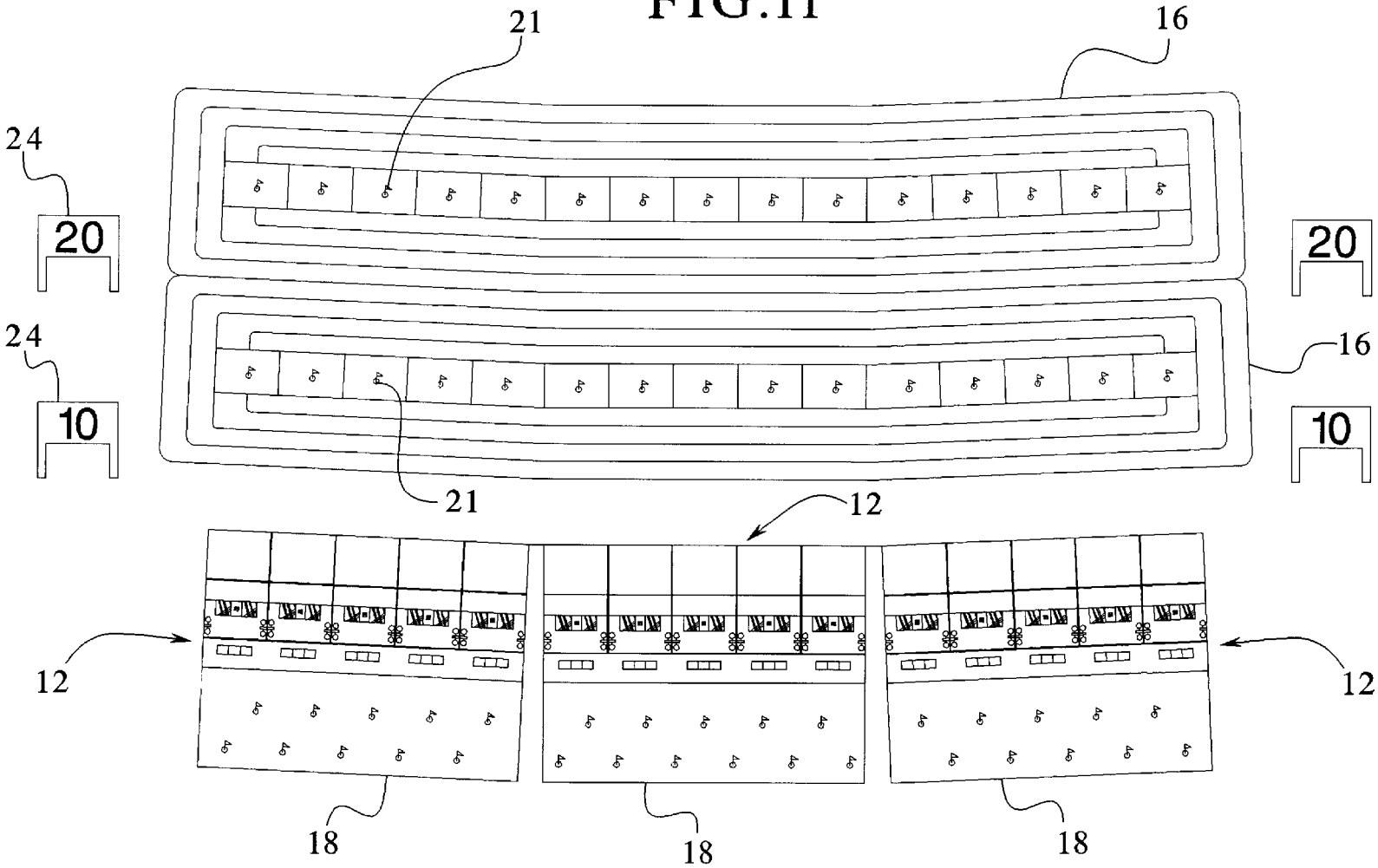
FIG. 11 is a top plan view of another golf ball hitting area, putting green and target chipping area according to the present invention.

FIG. 11 shows modified golf ball hitting areas 12, target chipping area 16 and putting greens 18. Three modular golf ball hitting areas 12 have been provided which have been laid out with the middle golf ball hitting area 12 positioned approximately horizontal to the target greens. The left side and right side golf ball hitting areas 12 have been rotated inward toward the center of the golf course 10. This design provides improved access for the players on the left and rights sides of the fairway to shoot at all the target greens, in addition to concentrating golf balls toward the center of the fairway.

FIG. 11 also shows a change in the target chipping area 16 from the 10 yard marker 24 to combined 10 and 20 yard target chipping areas 16. The combined 10 and 20 yard chipping areas 16 have two flags and holes 21 for each tee area. One flag and hole 21 is at the center of the 10 yard target chipping area 16 and the other flag and hole 21 is at the center of the 20 yard target chipping area 16. The combined 10 and 20 yard target chipping areas 16 provide more refined choices for chipping than only a 10 yard target chipping area 16. The first target green 14 at the 50 yard marker 24 can also be used for chipping. Accordingly, more options are available for the golfer to select the nearest target to shoot at while chipping to complete a hole's play. The left and right sides of the target chipping areas 16 have also been rotated inward toward the center of fairway to aline the left and right golf ball hitting areas 12 and to allow a better line of sight for the players to chip to the 10 or 20 yard target chipping areas 16.

As also shown in FIG. 11, the center putting green 18 behind the center golf ball hitting area 12 is positioned approximately horizontal to the golf course target greens, while the left and right side putting greens 18 are rotated inward toward the center of the fairway similar to their respective left and right side golf ball hitting areas 12.

The variations of the golf course 10 shown in FIGS. 9–11 increase player visibility of the target greens and hazards and their respective components. The angled golf ball hitting areas 12, target chipping areas 16 and putting greens 18 shown in FIG. 11 facilitate player view of the target greens and other areas on the golf course fairway. A modification of the target chipping area 16 to a 10 and 20 yard combined target chipping areas 16 with individual flags in the centers of the 10 and 20 yard target chipping areas 16 as shown in FIG. 11 provides for more realistic choices of short distance target approach shots in ordinary hole play rather than merely choosing between a 10 yard target chipping area 16 and the 50 yard target green 14.

Playing golf on the golf course 10 will now be further described. A score card can be provided to the golfer which defines the holes that the golfer can play. The score card informs the golfer of the distance to the hole and thus, which target green 14 to hit towards. For example, hole number 1 may be a 375 yard par 4 and the golfer will select and hit towards a target green closest to that distance. The golfer tees-up a golf ball on a selected hitting surface 30 and hits the golf ball.

Assuming the golf ball has landed in a playable location (for example, in-bounds) and not on the selected target green 14, the distance the golf ball traveled is determined. The golf ball travel distance is subtracted from the hole distance to determine the remaining distance to the hole. A target green nearest the remaining distance is selected and the golfer places the golf ball on the appropriate hitting surface 30, such as fairway, rough etc. The golfer then hits the next shot toward the selected target green 14. This is repeated until the golf ball lands on the target green 14 or is close enough to be chipped toward the target chipping area 16.

The remaining distance may not be exactly the same as a distance to any target green. Rounding will occur because some remaining distances will be greater and some shorter than a distance to any specific target green 14. However, over the course of playing multiple golf holes, the rounding effect may tend to even out.

If the golf ball lands in a sand trap 20, the golfer places the next golf ball in the sand hitting area 32 and hits the ball toward the selected target green 14. If the golf ball lands in a water hazard 22, the golfer places the next ball on the appropriate hitting surface 30 and hits toward the selected target green 14.

When the remaining distance to the hole is close to the distance from the hitting area 12 to the target chipping area 16, the golfer places the next golf ball on the appropriate hitting surface 30 and hits toward a selected hole location 21 in the target chipping area 16. The distance the golf ball lands from the hole location 21 is determined from the distance markings 17 on the target chipping area 16.

When the golf ball lands on the selected target green 14, the golfer places the next golf ball on the putting green 18 at a location from a hole 36 on the putting green 18 approximately equal to a distance the golf ball landed from the green center 46 of the target green 14. Of course, the golfer then puts to the selected hole 36 in the putting green 18.

The golfer's score for the hole is recorded on the score card and subsequent golf holes are similarly played.

Referring to FIGS. 12–15, a score card and method of scoring will be explained. FIG. 12 shows a score card 100, FIG. 13 shows a target green selection chart, FIG. 14 shows a three putt distance chart and FIG. 15 shows a three putt distance diagram. The score card 100 has a series of columns labeled 1 through 18 in which each column corresponds to one hole of the golf course. The score card 100 has a first box 102 which contains the total yardage for that hole or "Yards to Hole Green" (YTG). The total yardage is the actual hole yardage, either provided by the game or taken from actual score cards or other courses, and is entered into the first box 102. The first box 102 has a greater height than the boxes below it so that two yardage numbers can be placed in the box 102. The actual hole yardage is placed in the upper portion of the box 102 and the yardage to the target green nearest the actual yardage is placed in the lower portion of the box 102 below the actual yardage number. Because target greens are placed at 50 yard intervals on the golf course, 25 yards will be the maximum difference between the selected target green and the actual hole yardage. The par and whether a hazard is in play for a particular hole can also be entered into the box 102. For example, if hole 1 is a 157 yard par three hole with water hazards in play, 157-3W would be entered in the upper portion of the box 102. In the lower portion of the box 102, 150 would be entered which is the yards to the nearest target green closest to 157 yards. After the golfer hits the first tee shot, the distance the ball traveled is determined from actual observation or the ball distance locator system. The distance the ball traveled from the tee shot "Shot Yards 1" (SY1) is entered in a second box 104. The yardage entered in the second box 104 is subtracted from the yardage in the first box 102 and the result is the "Remaining Yards to Green" (RYG) which is entered in a box 106. The next target green must now be selected. The yardage to the nearest target green "Yards to the Nearest Target Green" is determined with the assistance of the target green selection chart shown in FIG. 13. The yards to the nearest target green will be within 25 yards of the actual "Remaining Yards to Green." The yards to the nearest target green is entered into box 108.

Referring to FIG. 13, the target green selection chart assists the golfer in identifying which target green to shoot at depending on the remaining yardage to the green. For example, if the remaining yardage to the green is more than 175 yards but less than 225 yards, the next shot would be played to the 200 yard target green and 200 would be entered into the box 108.

This process of shooting, subtracting, and selecting the nearest target green to shoot at next is continued and the yardages are entered into boxes 110–128 until the golf ball lands on a target green after which the golfer can prepare to putt out.

The three putt distance chart shown in FIG. 14 and the three putt distance diagram shown in FIG. 15 assist the player in determining the distance required to putt out. The putting distances are standardized to 10 ft, 20 ft or 40 ft putts based upon where the player's ball lands on a particular target green positioned 50 or more yards out from the golf ball hitting area 12. If the golf ball lands on the green center 46 of the target green, the golfer places a golf ball on the putting green 18 at a distance of 10 ft from a hole 36 and 10 ft is entered into the box 130 on the score card 100. Similarly, if the golf ball lands between the green center 46 and a perimeter of the target green, a 20 ft putt is required to putt out. A golf ball landing on the perimeter of the target green results in a 40 ft putt on the putting green 18. If the golfer is hitting to the target chipping area 16, the distance from the golf ball to the hole 21 on the target chipping area 16 can be determined and then, that distance would be entered in the box 130 and a corresponding putt can be played on the putting green 18.

The number of shots taken to reach the green is entered in box 132 and includes all shots to all of the target greens, except penalty strokes. Similarly, the number of putts taken on the putting green 18 to hole out is entered in box 134. The number of penalty strokes can be entered in box 136. The total score for the hole is entered in box 138 by adding together the number of strokes in boxes 132, 134 and 136.

Scoring of a round of golf can be entered manually on the score card 100 or an automatic system of scoring can be used with the golf course 10. The automatic scoring system can show the distance to the hole being played and automatically keep score for up to 4 players. The scoring system can allow for a preset course or entry of any desired existing or imagined course. The scoring system can automatically calculate the remaining distances to the hole green and select the nearest target green to shoot at next within 25 yards of the remaining distance to the green. The shot yardages can be recorded automatically or entered by the players by a keypad. Shots to the green, putts and penalties can be automatically tracked or entered by the keypad. A score for each hole, a nine hole total score and an 18 hole total score for each player can be displayed automatically.

While the presently preferred embodiments have been illustrated and described, numerous changes and modifications can be made without significantly departing from the spirit and scope of this invention. Therefore, the inventors intend that such changes and modifications are covered by the appended claims.

The invention is claimed as:

1. A golf course comprising:

a golf ball hitting area used for a plurality of golf holes;

a plurality of target greens spaced at various distances from the golf ball hitting area, at least one target green having a center pin section separated from a plurality of modular outer perimeter sections by ground terrain, the at least one target green having an outermost boundary defined by the plurality of modular outer perimeter sections, the modular outer perimeter sections being individual sections supported independently of each other;

a target chipping area adjacent the golf ball hitting area; and a putting green adjacent the golf ball hitting area.

2. The golf course of claim 1, further comprising at least one simulated hazard spaced away from the golf ball hitting area.

3. The golf course of claim 2, wherein the simulated hazard is selected from the group consisting of a water hazard, a sand trap, rough and combinations thereof.

4. The golf course of claim 2, wherein the simulated hazard comprises at least one hazard section, each hazard section having a visually attractive material attached to a material support.

5. The golf course of claim 2, wherein the simulated hazard is removably placed on a ground surface.

6. The golf course of claim 1, wherein the at least one target green comprises a visually attractive material attached to a material support.

7. The golf course of claim 6, wherein the modular outer perimeter sections are spaced apart from each other by ground terrain.

8. The golf course of claim 7, wherein the center pin section of the target green further comprises a signal indicative of a golf ball hitting the green center.

9. The golf course of claim 6, wherein the at least one target green is removably placed on a ground surface.

10. The golf course of claim 1, wherein the golf ball hitting area further comprises hitting areas selected from the group consisting of a tee shot hitting area, a fairway shot hitting area, a sand hitting area, a rough hitting area, and combinations thereof.

11. The golf course claim 1, further comprising protective netting at least partially around the golf ball hitting area.

12. The golf course of claim 1, further comprising netting extending from the golf ball hitting area toward the target greens, the netting having various opened and closed positions which define various sized openings in front of the golf ball hitting area.

13. The golf course of claim 1, wherein the target chipping area further comprises a target cup location and a distance indicator indicative of various distances from the target cup location.

14. The golf course of claim 1, further comprising distance markers at various positions spaced away from the golf ball hitting area.

15. The golf course of claim 1, further comprising a plurality of golf ball hitting areas adjacent each other and facing the same target greens.

16. The golf course of claim 15, wherein the target chipping area is adjacent the plurality of golf ball hitting areas and further comprises a plurality of target cup locations and distance indicators indicative of various distances from the target cup locations.

17. The golf course of claim 15, wherein the putting green is adjacent the plurality of golf ball hitting areas and further comprises a plurality of target cups.

18. The golf course of claim 15, each golf ball hitting area further comprising a protective netting between adjacent golf ball hitting areas.

19. The golf course of claim 15, further comprising netting extending from each golf ball hitting area toward the target greens, the netting for each golf ball hitting area having various opened and closed positions which define various sized openings in front of the golf ball hitting area.

20. The golf course of claim 2, wherein the at least one simulated hazard comprises of plurality of modular hazard perimeter sections.

21. A golf course comprising:

a plurality of golf ball hitting areas adjacent each other;

a set of target greens spaced at various distances from the golf ball hitting areas, all of the golf ball hitting areas associated with the same set of target greens, at least one target green having a center pin section separated from the plurality of modular outer perimeter sections by ground terrain, the at least one target green having an outermost boundary defined by the plurality of modular outer perimeter sections, the modular outer perimeter sections being individual sections supported independently of each other;

a target chipping area adjacent the golf ball hitting areas, the target chipping area having a plurality of target cup locations and a distance indicator indicative of various distances from the target cup locations, each target cup location associated with one of the golf ball hitting areas; and a putting green adjacent the golf ball hitting areas and having a plurality of target cups.

22. The golf course of claim 21, further comprising at least one simulated hazard spaced away from the golf ball hitting area.

23. The golf course of claim 22, wherein the golf ball hitting area further comprises hitting areas selected from the group consisting of a tee shot hitting area, a fairway shot hitting area, a sand hitting area, a rough hitting area, and combinations thereof.

24. The golf course of claim 23, wherein the center pin section green has a visually attractive material attached to a material support, and each modular outer perimeter section has a visually attractive material attached to another material support.

25. The golf course of claim 24, wherein the simulated hazard comprises at least one hazard section having a visually attractive hazard material attached to a hazard material support.

26. The golf course of claim 22, wherein the at least one simulated hazard comprises of plurality of modular hazard perimeter sections.

27. A method of making a golf course comprising the steps of:

providing a golf ball hitting area used for a plurality of golf holes;

providing a plurality of target greens spaced at various distances from the golf ball hitting area;

providing at least one target green with a center pin section separated from a plurality of modular perimeter sections by ground terrain;

arranging the plurality of modular perimeter sections to define an outer boundary of the at least one target green, the modular perimeter sections being individual sections supported independently of each other;

providing a target chipping area adjacent the golf ball hitting area; and providing a putting green adjacent the golf ball hitting area.

28. The method of claim 27, further comprising the step of providing at least one simulated hazard spaced away from the golf ball hitting area.

29. The method of claim 28, further comprising the step of providing the golf ball hitting area with hitting areas selected from the group consisting of a tee shot hitting area, a fairway shot hitting area, a sand hitting area, a rough hitting area, and combinations thereof.

30. The method of claim 28, wherein the step of providing at least one simulated hazard comprises providing a plurality of modular hazard perimeter sections.

31. A method of playing golf comprising the steps of:

(a) selecting a target green from a plurality of target greens spaced at various distances from a golf ball hitting area, the selected target green having a center pin section separated from a plurality of modular outer perimeter sections by ground terrain, the selected target green having an outermost boundary defined by the plurality of modular outer perimeter sections, the modular outer perimeter sections being individual sections supported independently of each other;

(b) hitting a golf ball from the golf ball hitting area toward the center pin section and the plurality of modular outer perimeter sections of the selected target green;

(c) determining a remaining distance between the golf ball and the selected target green;

(d) selecting a next target green which has a distance from the golf ball hitting area corresponding to the remaining distance;

(e) hitting the golf ball from the golf ball hitting area toward the center pin section and the plurality of modular outer perimeter sections of the next target green; and (f) repeating steps (c), (d), and (e) until the golf ball is on the selected target green.

32. The method of claim 31, wherein the step of selecting a next target green further comprising the step of rounding the remaining distance to be about equal to the distance the next target green is from the golf ball hitting area.

33. The method of claim 32, further comprising the step of hitting the golf ball towards a target chipping area adjacent the golf ball hitting area when the remaining distance is less than a distance from the golf ball hitting area to a target green closest to the golf ball hitting area by a predetermined amount.

34. The method of claim 32, further comprising the step of placing the golf ball on a putting green adjacent the golf ball hitting area when the golf ball lands on the last selected target green.

35. A golf course comprising:

a golf ball hitting area having a tee hitting area;

a plurality of portable target greens, at least one target green having a center pin section separated from a plurality of modular green sections arranged along an outer boundary of the target green by ground terrain, the modular green sections being individual sections supported independently of each other;

at least one portable hazard having a plurality of modular hazard sections arranged along an outer boundary of the hazard;

a target chipping area; and a putting green.

36. The golf course of claim 35, wherein at least one target green can have more than one configuration by changing the arrangement of the modular green sections.

37. The golf course of claim 35, wherein the at least one hazard can have more than one configuration by changing the arrangement of the modular hazard sections.

38. The golf course of claim 35 wherein the modular green sections comprise a flexible fabric attached to a frame.

39. The golf course of claim 35, wherein the golf ball hitting area has a removable and portable construction.

40. The golf course of claim 35, wherein the target chipping area has a removable and portable construction.

41. The golf course of claim 35, wherein the putting green has a removable and portable construction.

42. A simulated golf target green comprising:

a center pin section having a first flexible fabric attached to a center pin section frame; and a plurality of modular perimeter sections separated from the center pin section by ground terrain and arranged along an outer boundary of the green, each modular perimeter section having a second flexible fabric attached to a perimeter section frame, the modular perimeter sections being individual sections supported independently of each other.

43. The simulated golf target green of claim 42, wherein the modular perimeter sections comprise at least one rear perimeter section and at least one front perimeter section having differently shaped frames.

* * * * *